United States Patent [19]

Ridders

[11] Patent Number: 4,772,819

[45] Date of Patent: Sep. 20, 1988

[54] COMPACT HIGH EFFICACY FLUORESCENT LAMP

[75] Inventor: Johannes A. M. Ridders, Terneuzen, Netherlands

[73] Assignee: U.S. Philips Corp., New York, N.Y.

[21] Appl. No.: 3,534

[22] Filed: Jan. 13, 1987

[30] Foreign Application Priority Data

Jan. 13, 1986 [NL] Netherlands ..... 8600049

[51] Int. Cl.[4] ..... H01J 61/30; H01J 61/33

[52] U.S. Cl. ..... 313/493; 313/609; 313/634

[58] Field of Search ..... 313/493, 25, 634, 609, 313/611

[56] References Cited

U.S. PATENT DOCUMENTS

| | | | |
|---|---|---|---|
| 3,895,248 | 7/1975 | de Vrijer | 313/25 |
| 4,324,447 | 4/1982 | van der Wolf et al. | 313/634 |
| 4,337,414 | 6/1982 | Young | 315/56 |
| 4,383,200 | 5/1983 | van Zon et al. | 313/634 |
| 4,546,284 | 10/1985 | Renardus et al. | 313/25 |
| 4,603,277 | 7/1986 | Imamura et al. | 313/25 |

FOREIGN PATENT DOCUMENTS

| | | |
|---|---|---|
| 60-49550 | 3/1985 | Japan . |
| 60-100356 | 6/1985 | Japan . |

*Primary Examiner*—David K. Moore
*Assistant Examiner*—Sandra L. O'Shea
*Attorney, Agent, or Firm*—Brian J. Wieghaus

[57] ABSTRACT

Low-pressure mercury vapor discharge lamp having a tubular discharge vessel arranged within a lamp envelope. The discharge vessel consists of two, preferably generally helically bent tube parts which are connected together by a coupling joint which intersects the tube parts at a location spaced from their sealed ends remote from the electrodes. A cool area is formed in the discharge vessel near this coupling joint to control vapor pressure.

17 Claims, 3 Drawing Sheets

COMPACT HIGH EFFICACY FLUORESCENT LAMP

BACKGROUND OF THE INVENTION

The invention relates to a low-pressure mercury vapor discharge lamp comprising a tubular discharge vessel, which is arranged within a lamp envelope and curved at a number of areas. The vessel is sealed in a gastight manner and filled with mercury and a rare gas. Electrodes are arranged at the ends of the discharge vessel and are located at the same end of the space within the lamp envelope. A fluorescent lamp of this type is known from U.S. Pat. No. 4,383,200.

The known lamp comprises a discharge tube located within the lamp envelope and bent into the form of a hook. The lamp has small dimensions and serves as an alternative to an incandescent lamp for general illumination purposes.

The discharge vessel of this lamp is surrounded by the lamp envelope. During operation of the lamp the temperature easily increases to such a high value that the optimum mercury vapor-pressure for the conversion of supplied energy into ultraviolet resonance radiation of mercury in the discharge vessel (approximately $6\times10^{-3}$ Torr) is exceeded. It is then necessary to take special measures in order to stabilize the mercury vapor-pressure at the optimum value, for example by providing a vapor-pressure controlling amalgam in the discharge vessel or by providing the discharge vessel with an appendix which is kept at a relatively low temperature (see U.S. Pat. No. 4,546,284). It is, however, complicated to provide such an appendix.

Moreover, the discharge vessel of the known lamp is secured only on one side within the lamp envelope. This makes the lamp vulnerable to vibrations and shocks.

SUMMARY OF THE INVENTION

It is an object of the invention to provide a compact low-pressure mercury vapor discharge lamp, such as a fluorescent lamp, having a high efficiency of energy conversion, which does not have the drawbacks of the known lamp.

To this end, in a fluorescent or other low-pressure mercury vapor discharge lamp of the type described in the opening paragraph, the tubular discharge vessel is composed of two bent tube parts, each having an electrode at one end and being sealed in a gastight manner at its other, far end. At least one of the tube parts is bent in a generally helical shape. The tube parts are connected together by a coupling joint intersecting the parts at locations spaced some distance from the far ends, the coupling joint being located at the end of the lamp envelope remote from the electrodes.

The tubular discharge vessel of the lamp according to the invention has a longer length than the discharge vessel of the known lamp having the same dimensions. The efficiency of the conversion to ultraviolet energy, and therefore the efficacy of a fluorescent lamp of this type, will thus be greater than that of the known lamp.

The tube parts are initially formed from, for example, a straight tube which is provided with a luminescent layer and which is subsequently bent through approximately 180° at positions one third and two thirds along its length. A stem with an exhaust tube and an electrode is provided at one end in each tube part, and the other or far end is sealed in a gastight manner.

Preferably, the two tube parts are substantially identical. Each is generally helical; that is, the first bend is about an axis which may be defined, generally transverse to the central axis of the tubing. From the electrode end to the first bend, around that bend, and then to the second bend, the tubing is following a path around the defined axis in a given direction. This portion of the part may conveniently be formed as two substantially straight, parallel runs of tubing, lying in a plane perpendicular to the defined axis. Going through the second bend, and extending along a generally straight run to the sealed end, the tubing follows a path continuing the same given direction of rotation about the defined axis, but also advancing in an axial direction in a generally helical fashion. For a given configuration of lamp envelope, which usually has a circular cross-section about a lamp axis, the plane defined by the tubing of a part (i.e., a plane perpendicular to the defined axis) is parallel to the lamp axis. The exact angle of the second bend, which will involve bending through approximately 180° about an axis which is skewed with respect to the axis of the first bend, is chosen so that the sealed ends of the two tube parts may be close to each other when the two parts are arranged with their electrode ends spaced diametrically with respect to the lamp axis and with the helices of the two parts advancing toward each other.

Subsequently the two tube parts are connected together at a location near, but spaced from, the said sealed ends, by means of the coupling joint. The discharge vessel thus formed is exhausted and provided with the mercury and rare gas atmosphere and the exhaust tube is sealed in a gastight manner. A relatively cool space is then obtained between the sealed end of each tube part (that is, the end where there is no electrode) and the coupling joint, because no discharge passes through these spaces during operation of the lamp. The mercury vapor pressure is then stabilized at the value of $6\times10^{-3}$ Torr during operation, so that the conversion of supplied energy into ultraviolet radiation is optimum. This effect is further enhanced because the cool space is located at the end within the lamp envelope remote from electrodes.

Preferably the discharge vessel and the lamp envelope (which preferably consists of a synthetic material) are connected together at an area near the sealed far ends of the tube parts remote from the electrodes. This connection is provided by an inwardly extending collar formed in the envelope. The discharge vessel is then anchored between two ends of the envelope facing each other. The risk of breakage of the discharge vessel as a result of vibrations and shocks is thus smaller than in the known lamp.

In a different embodiment, the end wall of the lamp envelope is provided with a recess at the area of the coupling joint and the cool space ends, the bottom part of the recess having an aperture accommodating the far ends of the tube parts.

In this manner the far ends of the tube parts are exposed to and cooled by the atmosphere surrounding the lamp, but the risk of breakage of the ends of the tube parts protruding from the lamp envelope is small.

The lamp according to this preferred embodiment of the invention is compact, and has a high efficiency and a remarkably homogeneous light distribution. In addition, the lamp can be manufactured in a relatively simple manner in mass production.

It will be recognized that the "generally helical" construction of at least one of the tube parts is chosen so that one can obtain a maximum length of tube between the electrode end and the far sealed end, within a convenient outer envelope and with orientation of the far end at an end of the lamp remote from the electrodes. In the preferred embodiments the discharge vessel operates in conjunction with a ballast unit contained within the base of the lamp just beyond the electrodes. To minimize the outline dimensions of the lamp, it may be desirable that the two electrodes be to the same side of the lamp, as well as at the same end. With such construction, desirably one tube part is generally helical, but only the portion between the electrode and the second bend has a similar configuration in the second tube part. The second bend of this latter part is then so oriented that the far sealed end of the second part is at a side of the lamp opposite the side on which the two electrodes and the far sealed end of the first tube part are located.

The invention will be further described with reference to the accompanying drawing.

DESCRIPTION OF THE PREFERRED EMBODIMENTS

Figure 1:
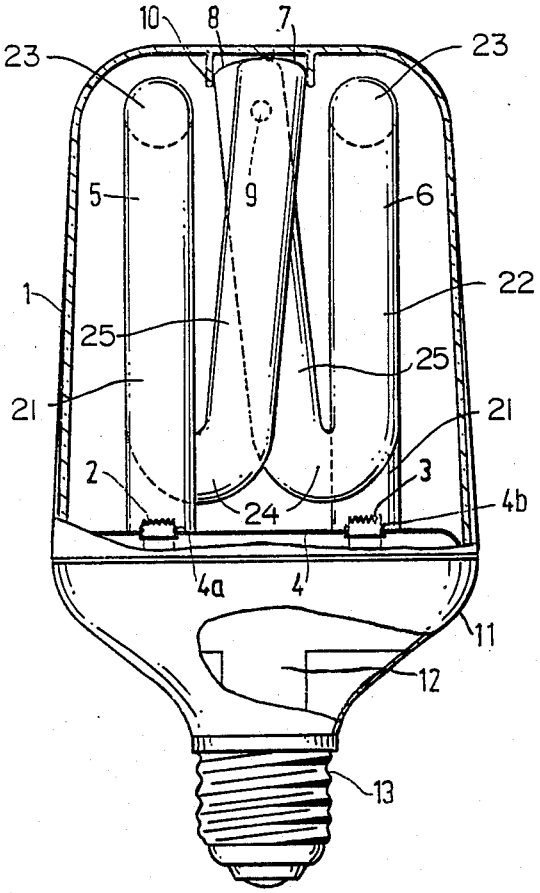
FIG. 1 is a diagrammatic elevation of a first lamp embodiment having generally helical tube parts according to the invention, partly in cross section.

The lamp of FIG. 1 comprises a lamp envelope 1 of a transparent synthetic material within which a tubular discharge vessel is arranged. The vessel is sealed in a gastight manner and is filled with mercury and a rare gas. At the ends of the vessel electrodes 2 and 3 are arranged. The electrodes are located diametrically with respect to the longitudinal axis of the lamp envelope 1. A synthetic material plate 4, to which the discharge vessel is secured by means of the collars 4*a* and 4*b*, is provided at this end. The plate is also connected to the lamp envelope 1.

The discharge vessel, whose inner wall is provided with a luminescent layer, is composed of two substantially identical, generally helically bent tube parts 5 and 6. Each of these tube parts supports an electrode at one end and is sealed in a gastight manner at its other, far end (7, 8). At some distance (for example, 1 to 3 times the internal diameter of the tube parts) from these sealed ends the two tube parts are connected together by a coupling joint 9 shown diagrammatically. This coupling joint (through which the discharge passes during operation) is formed by fusing collars facing each other and surrounding apertures in the walls of the tube parts.

A method of fusing collars of this type is described in U.S. Pat. No. 4,324,447 and is particularly advantageous for joining multiple bent tube parts because the glass wall of the discharge vessel is only locally heated for the purpose of providing the coupling joint.

The ends 7 and 8 of the tube parts now constitute a relatively cool area in the discharge vessel, and determine the magnitude of the mercury vapor pressure in the discharge vessel during operation of the lamp. The ends 7 and 8 are secured with the aid of a clamping joint in the form of an inwardly extending circular collar 10 forming part of the synthetic material lamp envelope 1. The discharge vessel is thus rigidly clamped between the envelope and the synthetic material plate 4.

Figure 4:
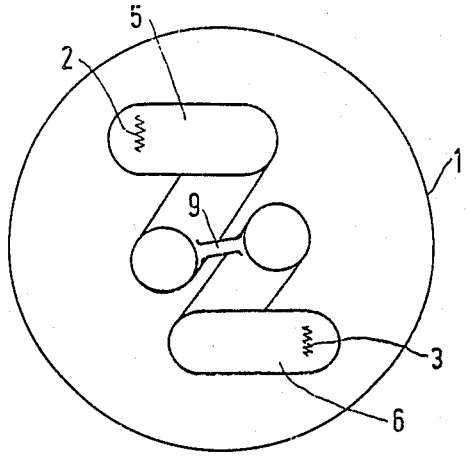
FIG. 4 is a top view of the lamp in FIG. 1 rotated 90 degrees.
Figure 5:
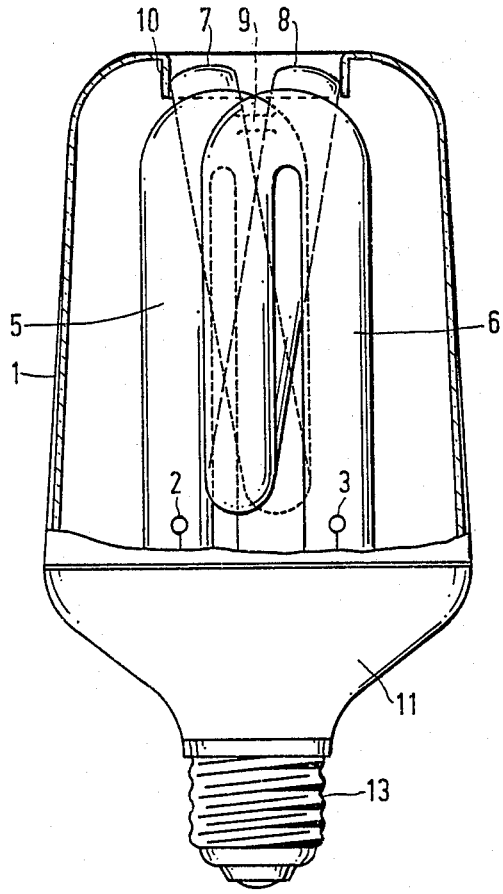
FIG. 5 is a diagrammatic elevation of the lamp in FIG. 2 rotated 90 degrees.

For simplicity in manufacturing, and maximum use of space within the generally cylindrical (slightly tapered) envelope 1, each tube part is only generally helically bent. See FIG. 4. The electrode is incorporated in a gastight manner at the end of a first straight portion 21. This straight portion is connected to a second straight portion 22 via a U-shaped bent portion 23. This second portion is in turn connected via a second, generally U-shaped bent portion 24 with a third straight portion 25 which is sealed at its far end (for example, at 7).

As is shown in the drawing the longitudinal axes of the two tube portions 25 are skewed at an acute angle near the coupling joint. This angle is 10° at a maximum. The collar 10 then forms a reliable clamping joint with the outer wall of the far ends.

Below the envelope 1 the lamp is provided with a conical synthetic material lamp tray 11 accommodating an electronic circuit 12 (diagrammatically shown) for operating and starting the lamp. A circuit of this type is described in the Netherlands patent application No. 8400923 laid open to public inspection, to which U.S. Pat. No. 4,647,820 issued 3/3/87 corresponds. At the small end of the tray 11 the lamp has an Edison cap 13 with which it can be screwed into an incandescent lamp holder.

Figure 2:
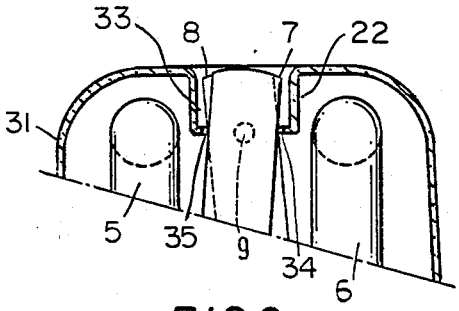
FIG. 2 is a sectional view of part of a second embodiment of a lamp according to the invention.

FIG. 2 shows a detail of the upper side of a synthetic material lamp envelope 31 of an alternative embodiment of the lamp according to FIG. 1. The same components as in the lamp according to FIG. 1 have the same reference numerals. The wall of the lamp envelope is bent inwards to form a collar 32 surrounding a recess 33. An aperture 35, through which the ends 7 and 8 of the tube portions 25 of the parts 5 and 6 extend, is formed in the bottom part 34 of the recess. Since the ends 7 and 8 directly communicate with the ambient surrounding the lamp, the temperature of these ends is relatively low. The recess is formed and dimensioned in such a manner that the cool ends of the tube parts, located above the coupling joint 9, do not protrude beyond a plane defined by the wall of the lamp envelope adjoining the recess.

In a practical embodiment of the lamp according to FIG. 1 the total length of the tubular discharge vessel (that is, the sum of the length of the separate tube parts 5 and 6) is 45 cm. A luminescent layer consisting of a mixture of two phosphors, namely green luminescing cerium magnesium aluminate activated with terbium, and red luminescing yttrium oxide activated with trivalent europium, was provided on the inner wall of the discharge vessel whose internal diameter is approximately 10 mm. The length of the total lamp (measured from the top of the lamp envelope to the end of the cap 13) was 14.5 cm, and the maximum width of the lamp was 7.5 cm. The luminous efficiency was 1200 lm for an applied power to the lamp of approximately 20 W (including electronic circuit).

Figure 3:
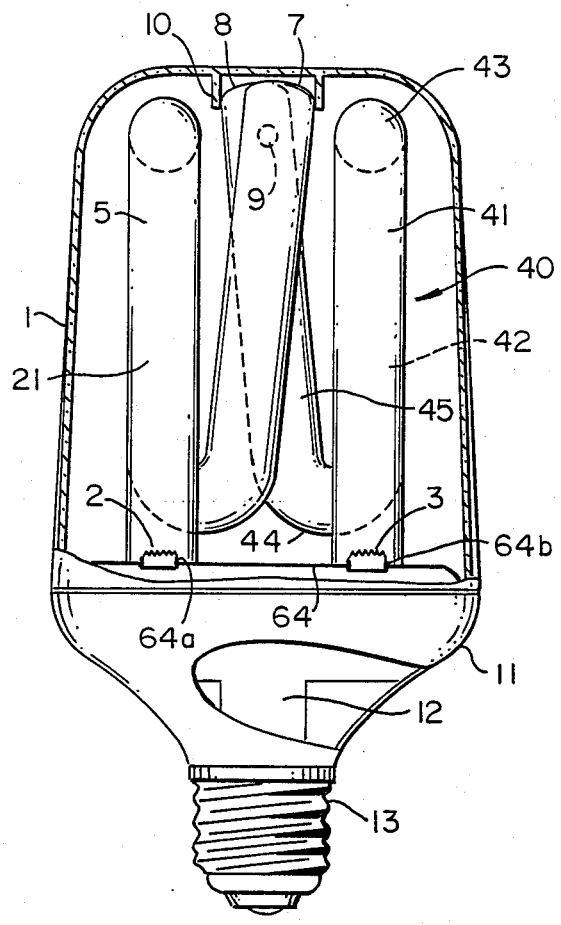
FIG. 3 is a view, similar to FIG. 1, of a third embodiment having one generally helical tube part.

The embodiment shown in FIG. 3 uses many of the same parts as that of FIG. 1, similar or identical parts being shown with the same reference numeral as FIG. 1. Thus the generally helical bent tube part 5 may have a shape identical to that of the tube part 5 of FIG. 1. The tube part 40, however, is partially different in its directions of bending. The first straight portion 41, at whose end electrode 3 is located, is arranged to the same side of the axis of the lamp as the portion 21 of the tube part 5, rather than being diametrically opposite as in the FIG. 1 embodiment. This straight portion 41 is connected to a second straight portion 42 via a U-shaped bent portion 43. This second portion 42 is in turn connected via a second, generally U-shaped bent portion 44 with a third straight portion 45 which is sealed at its far end 8. Unlike the bent portion 24, which continued the helical direction about an axis generally perpendicular to a plane defined by the first and second straight portions, the bent portion 44 is bent about an axis which is approximately perpendicular to the axis of bending of the portion 43. Thus the third straight portion 45 does not continue in a generally helical pattern from the portions 41, 42 and 43.

This embodiment provides substantially the same total arc path length as the embodiment of FIG. 1, but offers the advantage that the synthetic material plate 64, corresponding to the plate 4 of the FIG. 1 embodiment, has its collars **64*a* and 64*b* formed to the same side of the lamp, rather than being diametrical about the lamp axis. This may provide easier connections, or space to the other side of the lamp where the plate 4 might even have a raised portion to provide clearance for components of the circuit 12**.

It will be clear to those of ordinary skill in the art that many variations from the disclosed embodiments fall within the scope of the invention. For example, in some applications a more spherical outer envelope is considered attractive, and in that situation the two tube parts may advantageously be more nearly helical in form.

When the two tube parts are not identical, as in the embodiment of FIG. 3, the advantage of having a coupling joint connecting with one of the tube parts at a distance spaced from the sealed far end will be provided even if only one of the tube parts has a portion extending beyond the coupling joint.

In another variation which might have advantage for surface uniformity of brightness, at some sacrifice in efficacy, each tube part may have a configuration generally like that of the tube part 40, so that in point of fact neither tube part would truly be generally helical. Such a construction could nonetheless permit the use of two identical tube parts, having the sealed far ends at the end of the lamp remote from the electrodes, either in the style shown in FIG. 1 or in FIG. 2, so that the pressure control of the mercury gas may still be obtained.

What is claimed:

1. A low pressure mercury vapor discharge lamp, comprising:

(a) a lamp base;

(b) a lamp envelope secured on said lamp base having a surface romote from and facing said lamp base;

(c) a pair of electrodes; and (d) a discharge vessel having said pair of electrodes disposed at respective vessel ends arranged adjacent said lamp base, said discharge vessel defining a continuous discharge path between said electrodes, said vessel comprising a pair of adjacent straight sections having adjacent ends, said adjacent ends being disposed proximate said envelope surface facing said lamp base, and a coupling section joining said straight sections proximate said adjacent ends, said discharge path extending from one electrode along the discharge vessel through one of said straight sections, passing through said coupling section, and extending along the other said straight section through the remaining discharge vessel and ending at the other electrode; and said envelope surface facing said lamp base comprising means for securing said straight sections to said lamp envelope proximate said adjacent ends.

2. A lamp as claimed in claim 1, wherein said means for securing said adjacent end to said lamp envelope comprises said envelope surface having protuberances spaced to engage said adjacent ends.

3. A lamp as claimed in claim 1, wherein said means for securing said adjacent ends to said envelope comprises said base facing surface defining a recess in said envelope, the bottom of said recess having an aperture for receiving said adjacent ends, said ends communicating with ambient air surrounding said lamp.

4. A lamp as claimed in claim 1, wherein said coupling section is formed by fusing collars on each straight section, said collars facing each other and surrounding apertures in the walls of said adjacent straight sections.

5. A lamp as claimed in claim 4, wherein said adjacent straight sections are skewed with respect to each other at a maximum angle of ten degrees.

6. A lamp as claimed in claim 3, wherein said adjacent straight sections are skewed with respect to each other at a maximum angle of ten degrees.

7. A lamp as claimed in claim 2, wherein said adjacent straight sections are skewed with respect to each other at a maximum angle of ten degrees.

8. A lamp as claimed in claim 2, wherein said adjacent ends and said coupling section are arranged to comprise a surface which transfers sufficient heat so that said surface is the coolest portion of said discharge vessel.

9. A lamp as claimed in claim 3 wherein said adjacent ends and said coupling section are arranged to comprise a surface which transfers sufficient heat so that said surface is the coolest portion of said discharge vessel.

10. A low pressure discharge lamp as claimed in claim 1, wherein said discharge vessel comprises, between each one of said adjacent straight sections and a respective electrode, two other straight sections and two substantially U-shaped bent sections, said straight sections being interconnected sequentially by respective bent sections.

11. A low pressure discharge lamp as claimed in claim 10, wherein said straight sections are skewed with respect to each other and the portions of the discharge vessel extending from each electrode to a respective one of said adjacent ends is generally helically bent.

12. A lamp as claimed in claim 10, wherein said means for securing said adjacent ends to said lamp envelope comprises said envelope surface having protuberances spaced to engage said adjacent ends.

13. A lamp as claimed in claim 10, wherein said means for securing said adjacent ends comprises said surface defining a recess in said envelope, the bottom of said recess having an aperture receiving said adjacent ends, said ends communicating with ambient air surrounding said lamp.

14. A lamp as claimed in claim 11, wherein said means for securing said adjacent ends to said lamp envelope comprises said envelope surface having protuberances spaced to engage said adjacent ends.

15. A lamp as claimed in claim 11, wherein said means for securing said adjacent ends comprises said surface defining a recess in said envelope, the bottom of said recess having an aperture receiving said adjacent ends, said ends communicating with ambient air surrounding said lamp.

16. A low pressure mercury vapor discharge lamp comprising:

(a) a lamp base;

(b) a lamp envelope secured on said lamp base;

(c) a pair of electrodes; and (d) a closed discharge vessel having said electrodes disposed at respective ends thereof and defining a continuous discharge path between said electrodes, said vessel comprising, two substantially U-shaped portions having elongate legs and arranged in parallel planes, said U-shaped portions being displaced with respect to each other in said parallel planes so that a leg of one U-shaped portion is aligned with a plane between the legs of the other U-shaped portion transverse to said parallel planes, two straight portions arranged between said U-shaped portions each having an end connected to a leg of a respective U-shaped portion by a respective bent portion and a free end remote from said lamp base, said straight portions being skewed with respect to each other and with respect to the legs of said U-shaped portions and arranged with said free ends adjacent each other, when projected onto the parallel plane of its respective U-shaped portion each skewed straight portion extends diagonally between the legs of its respective U-shaped portion, and a coupling section joining said skewed straight portions near said free ends, said electrodes being disposed in a respective U-shaped portion adjacent said lamp base in the leg not joined to a said skewed straight portion, said discharge starting at one of said electrodes passing through its respective U-shaped portion and its respective bent portion along its respective skewed straight portion through said coupling section along the other of said skewed straight portions through the other bent portion and the other U-shaped portion and terminating at the other electrode.

17. A lamp as claimed in claim 16, wherein said free ends of said skewed straight portions and said coupling section are arranged to comprise a surface having sufficient heat transfer so that said surface is the coolest portion of said discharge vessel.

* * * * *